United States Patent [19]

Kitai et al.

[11] Patent Number: 4,646,079

[45] Date of Patent: Feb. 24, 1987

[54] SELF-SCANNING ELECTROLUMINESCENT DISPLAY

[75] Inventors: Adrian H. Kitai; George J. Wolga, both of Ithaca, N.Y.

[73] Assignee: Cornell Research Foundation, Inc., Ithaca, N.Y.

[21] Appl. No.: 649,584

[22] Filed: Sep. 12, 1984

[51] Int. Cl.[4] ..... G09G 3/30

[52] U.S. Cl. ..... 340/781; 340/794; 340/703; 250/213 A; 315/169.3

[58] Field of Search ..... 340/781, 811, 792, 793, 340/794, 714, 718, 719, 703, 825.81; 250/213 A; 313/531, 537, 540, 500; 315/169.3

[56] References Cited

U.S. PATENT DOCUMENTS

| | | | |
|---|---|---|---|
| 2,900,574 | 8/1959 | Kazan | 340/781 |
| 2,904,626 | 9/1959 | Rajchman et al. . | |
| 2,925,532 | 2/1960 | Larach . | |
| 3,054,929 | 9/1962 | Livingston . | |
| 3,627,924 | 12/1971 | Fleming et al. . | |
| 3,752,910 | 8/1973 | Lewis . | |
| 3,761,617 | 9/1973 | Tsuchiya et al. . | |
| 3,798,502 | 3/1974 | Ngo . | |
| 3,940,757 | 2/1976 | Purchase | 250/213 A |
| 3,953,672 | 4/1976 | Ninke . | |
| 3,988,536 | 10/1976 | Morica | 250/213 A |
| 4,074,319 | 2/1978 | Goldschmidt et al. . | |
| 4,086,514 | 4/1978 | Havel . | |
| 4,090,219 | 5/1978 | Ernstoff et al. . | |
| 4,110,662 | 8/1978 | Greeneich et al. . | |
| 4,110,664 | 8/1978 | Chang . . | |
| 4,155,030 | 5/1979 | Chang . | |
| 4,170,772 | 10/1979 | Bly . | |
| 4,210,848 | 7/1980 | Suzuki et al. | 340/781 |
| 4,210,934 | 7/1980 | Kutaragi . | |
| 4,234,821 | 11/1980 | Kato et al. . | |
| 4,266,223 | 5/1981 | Frame . | |
| 4,275,336 | 6/1981 | Marrello et al. . | |
| 4,322,720 | 3/1982 | Hughes | 340/781 |
| 4,366,504 | 12/1982 | Kanatani . | |
| 4,467,325 | 8/1984 | Lustig | 340/794 |
| 4,509,045 | 4/1985 | Lustig | 340/781 |

OTHER PUBLICATIONS

T. Inoguchi and S. Mito, "Phosphor Films".

Uchida et al., "A Full-Color Matrix Liquid-Crystal Display with Color Layers on the Electrodes", IEEE Transactions on Electron Devices, vol. ED-30, No. 5, pp. 503-507, 1983.

Miller et al., "Electroluminescent Display Technology", Advances in Display Technology, SPIE, vol. 199, pp. 71-75, 1979.

*Primary Examiner*—Gerald L. Brigance

*Attorney, Agent, or Firm*—Jones, Tullar & Cooper

[57] ABSTRACT

A thin film electroluminescent display panel is disclosed. The panel incorporates plural rows of hysteretic electroluminescent units which are electrically and optically coupled to enable data to be entered serially into each row to establish on and off conditions in selected units. The units are paired to form pixels, one unit in each pixel serving to transfer data and the other being energizable by a display signal. The pixels are energized to display the image represented by the entered data. Auxiliary pixel rows may be provided to permit simultaneous display of an image and entry of the next image to be displayed. Multiple pixels may be provided to produce multicolor images.

23 Claims, 11 Drawing Figures

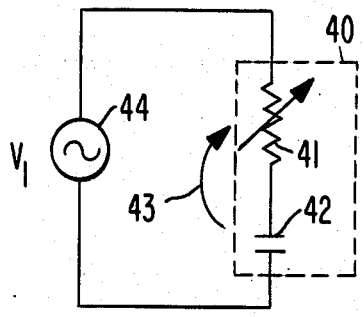
FIG. 2
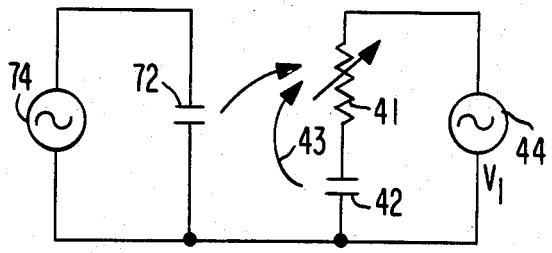
FIG. 5
FIG. 3
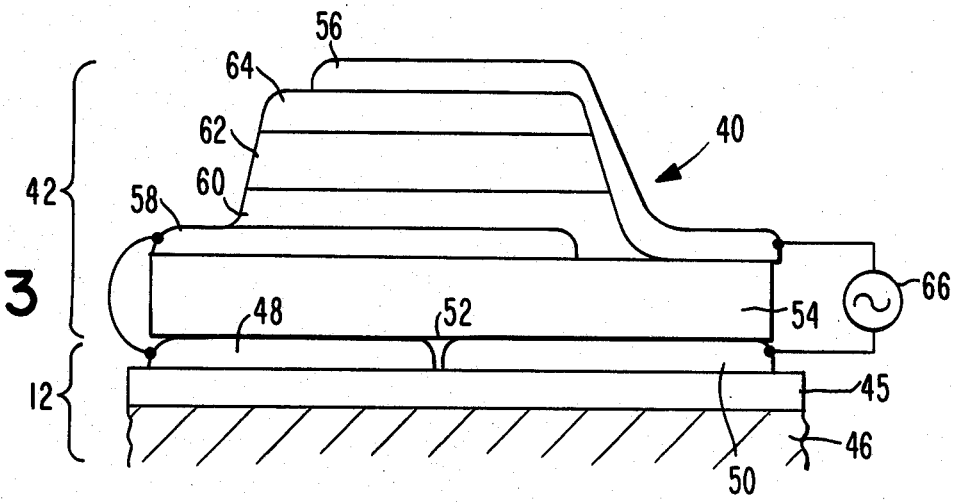
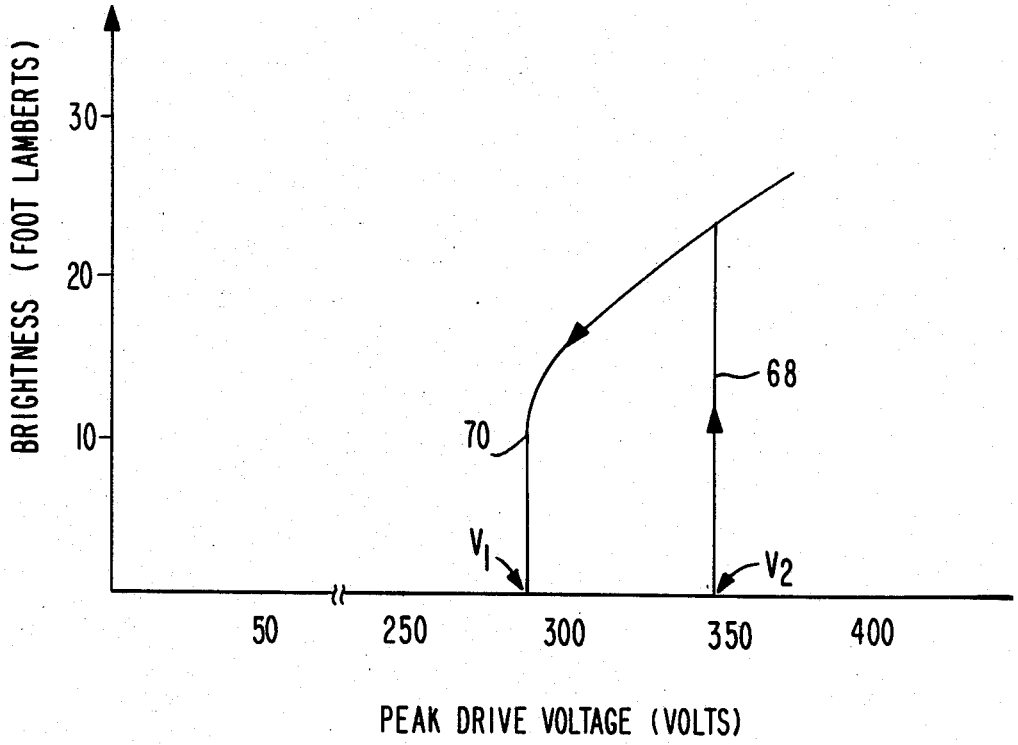
FIG. 4

SELF-SCANNING ELECTROLUMINESCENT DISPLAY

This invention was made with Government Support under Grants Nos. ECS-8200312 and DMR-7924008-A03, awarded by The National Science Foundation. The Government has certain rights in the invention.

BACKGROUND OF THE INVENTION

The present invention relates, in general, to thin film electroluminescent display panels, and more particularly to a self-scanning circuit and method of operating such panels which permits rapid entry of picture information for subsequent display.

Electroluminescent devices have been well known for many years, and their potential uses were early recognized. Typical of such devices is that shown in U.S. Pat. No. 2,900,574 to Kazan, which describes the operation of an electroluminescent system for producing a moving spot of light. As therein explained, many phosphor materials may be caused to emit visible radiation by subjecting them to alternating current voltages of sufficient magnitude, applied across the phosphor. Bursts of electroluminescence will occur for each polarity change induced by the AC voltage; accordingly, such a voltage is used to produce a seemingly constant electroluminescence by applying the voltage at a frequency which is shorter than the retentivity of the human eye. Such electroluminescence results from a redistribution of electrons in the crystal structure of the electroluminescent material and the consequent emission of light from that material.

Many attempts have been made to use this phenomenon in the production of a large image utilizing, in a panel or screen, a plurality of discrete electroluminescent pixels, or picture elements, selectively energizable to provide a pattern of dark and light elements to provide the desired image. However, difficulties are encountered in selecting individual pixels in a large matrix of electroluminescent devices, for complex circuitry is generally required, and the application of these devices has, therefore, been limited. Another limiting factor in the production of an image is the relatively short decay time of an electroluminescent device phosphor. Although a short decay time is helpful in the case of a rapidly changing display, if an image is to remain visible for an appreciable time, it is necessary to reestablish the entire image on each cycle of the AC applied voltage to insure that the pattern of illumination is duplicated and that the image is thus retained.

Typically, the various elements in an electroluminescent panel are connected in an arrangement of the type shown in U.S. Pat. No. 3,054,929 to Livingston, U.S. Pat. No. 2,925,532 to Larach, or U.S. Pat. No. 3,627,924 to Flemming. All of these provide display panels which utilize a matrix of electroluminescent devices connected in a crossed grid array, having rows and columns of excitation conductors with electroluminescent devices connected therebetween at the grid intersections. Energization of a selected row and a selected column conductor applies a voltage across the single electroluminescent device located at the intersection of the row and column conductors. This allows the unique selection of each electroluminescent pixel in the matrix. To provide a complete display, the row conductors are scanned and at the energization of each row, the desired column conductors are selected to energize the electroluminescent devices in that row which correspond to the selected column conductors. The rows are energized sequentially and selected columns are energized during the selection of each row. When this is done very rapidly, the electroluminescent devices which are energized provide the desired pattern of illumination. Because each phosphor has a finite decay time, the image will quickly fade away if the same sequence of scanning the rows and selecting the columns is not immediately repeated, and by carrying out such repetition at a sufficiently high rate, the device will provide an apparent continuous image. The patents listed above provide variations on this general approach, the Larach patent showing a polychromic display by making adjacent rows one of three different colors, the Livingston patent showing the use of a beam switching tube for a crossed grid matrix, and the Flemming patent showing the use of electroluminescent devices for a TV display.

The cross grid or matrix systems of the prior art require extensive, complex, control circuitry. For example, if a matrix has M columns and N rows, then M+N control switching circuits are required to select and illuminate the individual electroluminescent devices in the matrix. For a large display panel, the number of circuits and the complexity of the control presents serious cost and reliability problems. Furthermore, to sustain a given picture, repetitive selection of each element in the display is required, further complicating the control problems.

SUMMARY OF THE INVENTION

It is an object of the present invention to provide a thin film electroluminescent display panel that is simple, utilizes few control circuits, and thus is more easily controlled and is more reliable than prior displays.

It is another object of the invention to provide, through a self-scanning technique, a method of selecting those electroluminescent devices in a row which are to be illuminated in a display panel.

An additional object of the invention is to provide a hysteretic electroluminescent module which can be restored to maximum brightness by a voltage less than that required to turn it on.

It is a further object of the present invention to provide an electroluminescent matrix display panel comprising rows of hysteretic modules, and wherein individual modules are selectable by way of a self-scanning technique, thereby eliminating the need for column selector circuitry.

It is another object of the invention to provide an electroluminescent matrix wherein an image may be retained through the use of a renewal, or "refreshment" technique, thereby eliminating the need for inserting an entire image for each repetitive cycle.

In accordance with the present invention, a display panel is provided having one or more rows of electroluminescent (EL) devices to be energized by applied electric fields. Each electroluminescent device forms a part of a hysteretic module, to be described, and each is connected to a source of data, which may produce data signals in the form of logic 1's and 0's, and to a pair of clock sources. The data signals, which are supplied serially, determine which devices in a row are to be illuminated for the display image, while the clock signals shift the data signals along the row to produce a pattern of illuminated (on) and non-illuminated (off) electroluminescent devices. This pattern is retained by means of low-level renewal, or refresher, signals which serve to hold the illuminated devices on without causing additional electroluminescent devices to become luminescent. This feature avoids the need for continuous reestablishment of the pattern by a serial shifting of data for each cycle of operation, and thus greatly simplifies maintenance of the desired display pattern. In this manner, the system produces and retains an image on a display panel by means of a rapid serial shift of data into each row of the panel, while substantially reducing the circuitry previously required for operating such display panel systems.

The present system may utilize low-power solid state devices which provide a high resolution image in a compact and lightweight display panel, but is not limited thereto.

A hysteresis effect is obtained, in a preferred form of the invention, by connecting a photoconductive element in series with an electroluminescent device to form a hysteretic electroluminescent module. When a high voltage is applied across this module, leakage through the photoconductor allows conduction which causes the electroluminescent device to emit light. This light falls on the photoconductor, thereby reducing its resistance and thus the impedance of the module. As long as the phosphor emits sufficient light, the photoconductor remains conductive and the impedance of the module remains low.

When turned on by a first applied voltage pulse, the electroluminescent device produces its full brightness, but its output immediately begins to decay. Application of a second voltage pulse of opposite polarity will restore it to its full brightness; application of an alternating voltage of the correct frequency and amplitude will keep the electroluminescent device on. The applied AC voltage thus renews, or refreshes, the electroluminescent device. Once the impedance of the network is reduced, this refreshment of the phosphor can be accomplished by means of a voltage which is lower than that required to initiate conduction. Both the decay time of the phosphor used for the electroluminescent device and the switching time of the photoconductor determines how often it is necessary to refresh the device to keep it on, and thus determine the required frequency of the display image renewal signal. In addition, the average brightness of the electroluminescent device can be regulated by controlling the frequency of the applied signal, for higher average brightness results from higher frequency applied signals.

A self-scanning data entry network is provided by electrically and optically coupling a plurality of the hysteretic illumination modules in side-by-side relationship with alternate modules being connected to a first alternating current clock source and the remaining modules being connected to a second alternating current clock source. Thus the first, third, fifth, etc., modules are connected in parallel to the first clock source, which is of a voltage sufficient to turn on only those electroluminescent devices which are connected in series to a conductive photoconductor. Similarly, the second, fourth, sixth, etc., units are connected in parallel to the second clock source, which is of a voltage equal in magnitude but not in phase to that of the first clock source.

The physical relationship of adjacent units is such that the light from a given electroluminescent device falls not only on the photoconductor which is in series with it, but also falls on the photoconductor in the next following module. A data entry electroluminescent device is provided at the beginning of the network and is energized by a data signal which is of sufficient voltage to cause it to luminesce. The output light from this data entry device falls on the photoconductor contained in the first illumination module, reducing its resistance. If a pulse (or pulse burst) from the first clock source follows the data pulse while the data entry electroluminescent device is still on, the photoconductor in the first module will be in its low impedance state, and the pulse (or pulse burst) from the first clock will be able to turn on the electroluminescent device in that first module. The light from the electroluminescent device in the first module illuminates not only its own photoconductor, but also that of the second module, so that a pulse (or pulse burst) from the second clock source will now be able to illuminate the second electroluminescent device.

If the first electroluminescent device is allowed to decay to its off condition before the first clock source supplies another pulse, then the next clock pulse will find that the first unit has returned to its high impedance value, and it will remain off even in the presence of a clock signal. However, the photoconductor in the third module will be illuminated by the light from the second module, and thus will be in its low impedance condition. Accordingly, the pulse from the first clock source will turn on the electroluminescent device in the third module. In this way, alternating pulses from the first and second clock signal sources will shift the entered data along the row. Data pulses are entered in the sequence whenever an illuminated device is required, and when a device is to be left off, no data is entered. In this way a series of on and off ("1" and "0") data pulses can be entered into a row of electroluminescent devices, the self-scanning operation produced by the clock signals passing the data along the row until an entire row is entered. This method of introducing data into a row of electroluminescent devices allows selection of each column position in the row, but eliminates all of the column switching circuitry of prior matrix arrangements and thereby greatly simplifies the optical panel.

To permit repetitive renewal of illuminated electroluminescent devices, adjacent hysteretic modules are paired to provide pixel units. Each electroluminescent device in a pair is driven by a different one of the first and second clock sources, so that alternate energization of these two sources causes a point of illumination to be scanned, or transferred along the row, as already explained. The scanning operation described above uses both clock sources to transfer data along a row; one of these sources also serves as a display source to provide a data display without transfer. The electroluminescent devices connected to either of the clock sources can be illuminated in the data transfer mode of operation. However, only those electroluminescent devices which are connected to the display source will function as data display devices. The remaining devices, which make up the second part of each pixel unit pair, are referred to as transfer devices. These latter devices function during the self-scanning operation to shift data along the row, but do not serve a display function.

A significant advantage of the self-scanning mode of operation, in addition to the advantages already outlined, is the ability to obtain multi-color displays. This is accomplished by forming three rows close to each other, the electroluminescent devices of one containing, for example, red phosphors, the next containing, for example, green phosphors and third containing, for example, blue phosphors. These three rows are grouped as a set and constitute subrows in a multicolor row to provide three colors at each row and column location, or pixel, in the matrix. Data is then entered by the self-scanning technique to illuminate selected electroluminescent devices in each subrow in accordance with the color desired. The same column location thus may be illuminated by more than one of the electroluminescent devices in a subrow to obtain the desired color blend for a pixel location.

Since phosphors or other activators produce characteristic colors at different efficiencies, some colors will be less intense than others upon application of the same electric field. This creates a color balance problem in conventional electroluminescent color displays. However, by taking advantage of the fact that an observer's eye retains the average light intensity over a period of time from a given spot, the present invention overcomes the color balance oroblem simply by renewing the phosphors in the subrows at varied repetition rates. This refreshes selected phosphors more or less often as required to increase or decrease the average intensity produced by those particular phosphors. By selecting appropriate frequencies at which the various electroluminescent devices are renewed, a close control over the average intensity of each pixel, and thus the color produced on the display image, is obtained.

A still further embodiment of the invention provides a row of auxiliary electroluminescent readout devices parallel to the data entry row so that data may be shifted, through the self-scanning technique, serially into a given row and may then be transferred in parallel to the auxiliary row. Only the auxiliary row would be visible, allowing additional data to be transferred into the first row for later parallel shifting and instantaneous display of a new image, when desired.

Although the various features of the present invention are described in terms of a portion of a single row of display pixels, duplication of the rows will provide a full matrix display panel having all of the advantageous features described above. A complete display panel allowing serial entry of display data, easy refreshment of the image being displayed, and elimination of the need for column controls is thus provided by this elegantly simple display system.

BRIEF DESCRIPTION OF THE DRAWINGS

The foregoing and additional objects, features and advantages of the present invention will become apparent to those of skill in the art from a consideration of the following detailed description of preferred embodiments thereof, taken in conjunction with the accompanying drawings, in which:

FIG. 2 illustrates schematically a hysteretic AC thin film electroluminescent module;

FIG. 3 illustrates the structure of the device of FIG. 2;

FIG. 4 shows a hysteretic curve obtained for the device of FIG. 3;

FIG. 5 is a modified form of hysteretic module;

DESCRIPTION OF PREFERRED EMBODIMENTS

Figure 1:
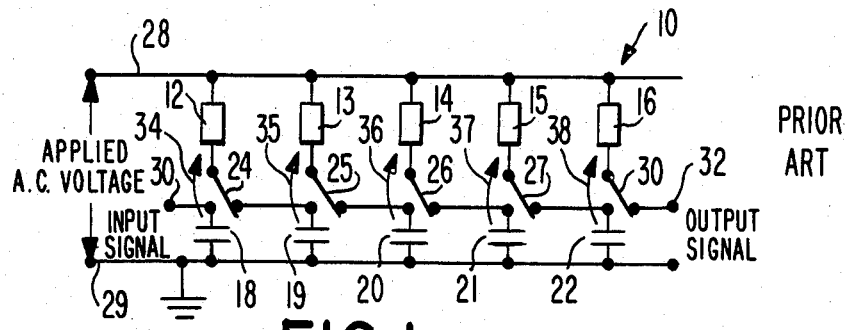
FIG. 1 illustrates a prior art system for scanning a spot of light.

FIG. 1 illustrates a prior art travelling spot device 10 utilizing a series of electroluminescent devices, as exemplified by U.S. Pat. No. 2,900,574. The device 10 consists of a row of photoconductors 12–16 and a row of corresponding electroluminescent devices 18–22. The corresponding photoconductors and electroluminescent devices, such as elements 12 and 18, may be defined as electroluminescent units. The photoconductors 12–15 of the first four units are connected in series through corresponding switches 24–27 either to the electroluminescent devices 19–22 of the adjacent units, respectively, as shown, or to the electroluminescent devices 18–21, respectively. An AC voltage is applied scross the electroluminescent units in parallel by way of lines 28 and 29, an input signal is applied across the first electroluminescent device 18 by way of line 30, and photoconductor 16 is connected through switch 30 either to output terminal 32 or to electroluminescent device 22. As indicated by arrows 34–38, the electroluminescent devices 18–22 are arranged to illuminate only their corresponding photoconductors 12–16.

The AC voltage applied across lines 28 and 29 is of sufficient magnitude to produce luminescence of the elements 19–22 when the the respective series-connected photoconductors 12–15 are decreased below a predetermined value. This decrease in impedance occurs when light is directed onto the photoconductor.

Application of a momentary trigger voltage to terminal 30 causes momentary electroluminescence in device 18, and the light therefrom is directed to photoconductor 12, reducing the resistance thereof. With the switches 24–30 positioned as shown, and an AC voltage across lines 28 and 29, electroluminescent device 19 will turn on and produce a spot of light. The light from device 19 will fall on photoconductor 13, reducing its impedance and allowing element 20 to be turned on, reducing the impedance of photoconductor 14. In this manner, the spot of light produced in electroluminescent device 18 will move along the linear array shown in FIG. 1.

Upon shifting switches 24–30 to connect photoconductors 12–16 to electroluminescent devices 18–24, the spot of light being produced by the row of electroluminescent devices 18–22 at that instant is stored. Thus, for example, if electroluminescent device 20 was on at the instant of shifting the switches, the light produced thereby would keep photoconductor 14 in its low resistance condition and the element 20 would continue to produce light. Upon returning the switches to the positions illustrated, the light spot would continue to propagate down the row.

The prior art thus discloses electroluminescent devices connected in series with, and illuminating only, corresponding photoconductors for producing a scanning spot of light and, upon operation of a plurality of series-connected switches to reconnect the electroluminescent network, for producing a stationary light display.

The present invention provides a self-scanning network for receiving and displaying an image through the use of optically and electrically coupled hysteretic electroluminescent modules. The network provides electrical control of data transfer, allows multicolor displays, and through the provision of auxiliary pixel units, permits viewing of a display during the transfer of a new image into the display panel. The basic element of the present invention is the hysteretic electroluminescent module illustrated at 40 in FIG. 2, to which reference is now made.

Module 40 includes a photoconductor 41 connected in series with an electroluminescent device 42 so that light 43 produced by device 42 falls on the photoconductor. An AC voltage $V_1$ from a source 44 supplied across the electroluminescent device 42 would normally be sufficient to turn device 42 on; however, the voltage drop across photoconductor 41 prevents this from occurring. If the voltage of source 44 is increased to a value $V_2$, then leakage through the photoconductor 41 will turn on electroluminescent device 42, lowering the resistance of the photoconductor 41 so that the electroluminescent device will remain on even if the source voltage is reduced to $V_1$.

The hysteretic AC thin film electroluminescent module 40 (ACTFEL) may be fabricated in the manner illustrated in FIG. 3, wherein a cadmium sulfide (CdS) photoconductive thin film 45 is evaporated onto a ceramic substrate 46. A pair of silver electrodes 48 and 50 are deposited on the photoconductive film 44 with a gap 52 therebetween of about 70 micrometers. The photoconductive cell 12 so formed is then placed under the glass substrate 54 of a thin film electroluminescent device 42 which includes front and rear electrodes 56 and 58. The electrodes are of transparent ITO, which enables light produced by the device to reach both the viewer and the photoconductor. A layer 60 of $Y_2O_3$ dielectric material is formed on the rear electrode 58 and this, in turn, is covered by a thin film of ZnS:Mn, which is approximately 1% manganese by weight and which is not intrinsically hysteretic. A second dielectric layer 64 of $Y_2O_3$ coverslayer 62 and is in turn covered by the front electrode 56. The rear electrode 58 is electrically connected to the silver electrode 48 as indicated by line 65, while the front electrode 56 is connected through an AC source 66 to the silver electrode 50 as by line 67 to complete the circuit.

FIG. 4 is a hysteretic curve obtained for the device of FIGS. 2 and 3, illustrating that although 350 volts ($V_2$) must be applied to the device to initiate its operation, once it becomes luminescent, as indicated by curve 68, a voltage of less than 300 volts ($V_1$) is all that is required to maintain it in the illuminated condition, as indicated by curve 70, as long as it does not turn off. The hysteretic curve of 64 was obtained with a drive voltage having a frequency of 450 Hz, providing 1.0 millisecond pulses of alternating polarity.

The electroluminescent module 40 of FIG. 2 is connected in the manner illustrated in FIG. 5 to demonstrate how it can be utilized in a chain of optically and electrically coupled devices to yield self-scanning. As illustrated, an additional electroluminescent device 72, which is the same as device 42, is arranged to illuminate the photoconductor 41 which is in series with device 42 and source 44. The electroluminescent device 72 is driven by a second AC voltage source 74. The voltage provided by source 44 is set at a value $V_1$ that is insufficient to initiate electroluminescence in module 40. Instead of increasing source 44 to $V_2$, module 40 may be turned on by momentarily exciting device 72 by means of a voltage supplied by source 74. Since device 72 illuminates photoconductor 41, the resistance of device 41 is reduced to enable the voltage $V_1$ to turn module 40 on. Then, since device 42 illuminates its photoconductor 41, device 42 will remain on as long as source 44 remains on, even if device 72 is turned off.

Figure 6:
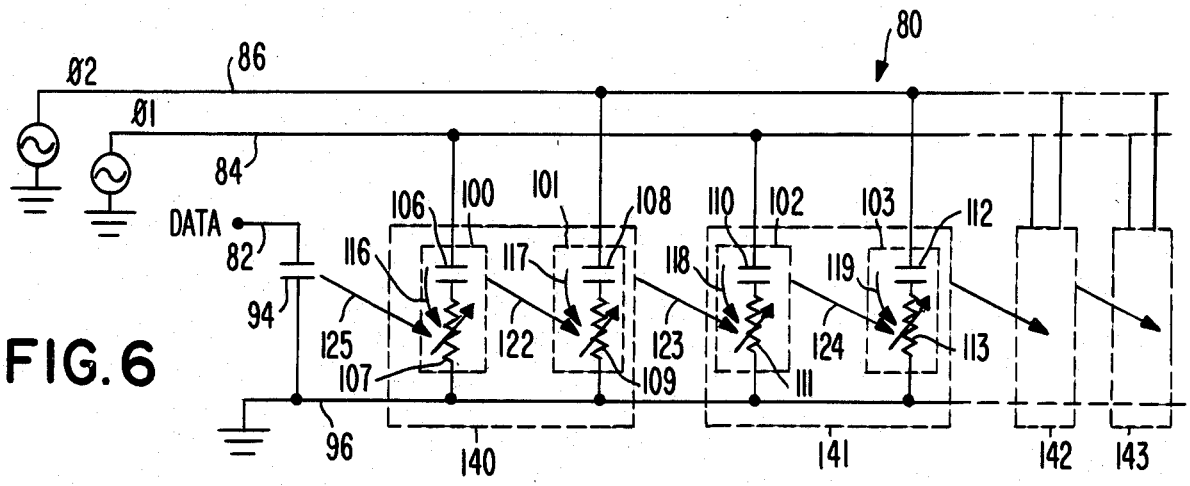
FIG. 6 is a schematic illustration of a self-scanning network consisting of optically and electrically coupled hysteretic modules.
Figure 7:
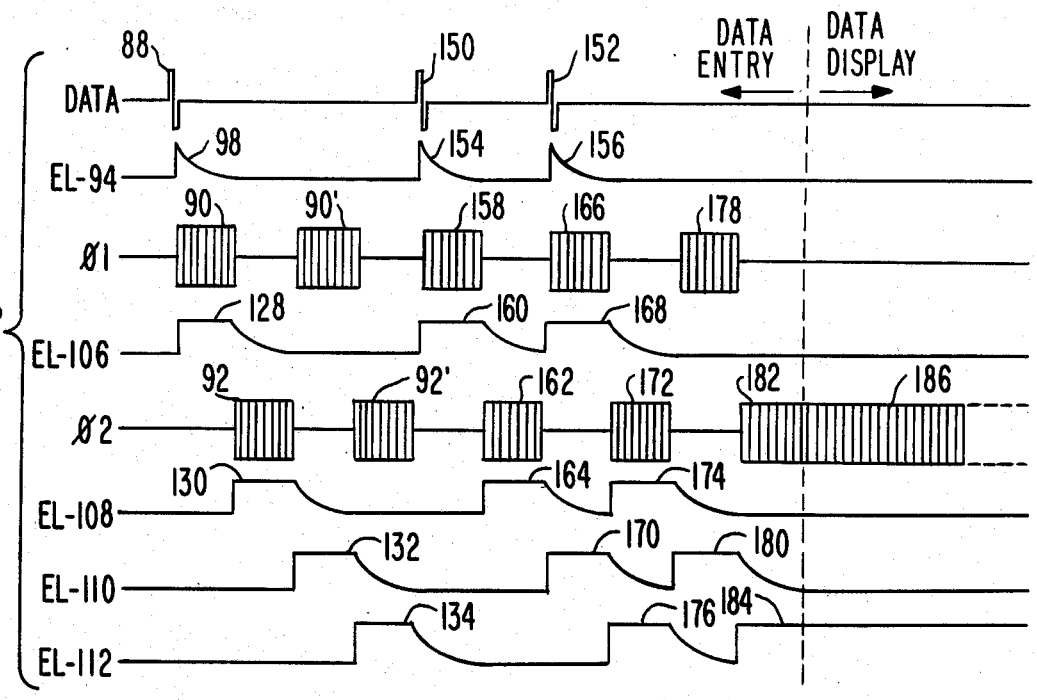
FIG. 7 is a graphical illustration of the waveforms for the network of FIG. 6.

The application of the principle demonstrated in FIG. 5 to a chain of coupled hysteretic modules connected to yield self-scanning is illustrated in the network of FIG. 6. In this network, data may be shifted into an entire row of electroluminescent devices by means of a single data line and two clock lines. Thus, a self-scanning network 80 includes a data input line 82, a first clock input line 84, and a second clock input line 86, the two clock lines being identified as Ø1 and Ø2, respectively, to indicate the sequence of these signals. As illustrated in FIG. 7, the data signal on line 82 is a short AC pulse 88, the Ø1 signal on line 84 is a longer AC pulse, or burst, 90, and the Ø2 signal on line 86 is a similar burst 92, the signals 90 and 92 being of sufficiently high frequency to maintain the electroluminescent devices to which they are applied at desired intensity levels during the time the voltage is applied.

Returning to FIG. 6, the data input line 82 is connected through an electroluminescent device 94 to a ground potential line 96. The data pulse 88 is of sufficient magnitude to cause the data entry electroluminescent device 94 to turn on. As indicated by the curve 98 in FIG. 7, electroluminescent device 94 reaches its maximum intensity immediately upon application of pulse 88 and then the brightness decays back to zero over a period of time which will depend upon the phosphor used and on the amplitude of the applied signal 88.

The self-scanning network 80 further includes a row of hysteretic electroluminescent modules, four such modules 100–103 being illustrated, although it will be understood that any number of such modules may be provided. Each electroluminescent module consists of an electroluminescent device and a series-connected photoconductor of variable resistance, as described with respect to FIG. 2. Thus, as illustrated in FIG. 6, the module 100 includes an electroluminescent device 106 and series photoconductor 107; the next following modules 101, 102 and 103 containing electroluminescent devices 108, 110, and 112, respectively, and photoconductors 109, 111, and 113, respectively. Modules 100 and 102 are electrically connected between the Ø1 clock line 84 and ground line 96, while the alternate modules 101 and 103 are connected between the Ø2 clock line 86 and the ground line 96.

Each electroluminescent device 106, 108, 110 and 112 is so arranged as to illuminate its series-connected photoconductor, as indicated by the arrows 116–119. At the same time, the electroluminescent devices each illuminate the photoconductor of the next following module, as indicated by the arrows 122, 123 and 124, thereby to optically couple each module with the next following module. The data entry electroluminescent device 94 is optically coupled to module 100, as indicated by arrow 125.

In operation, the Ø1 clock pulses 90 are applied to line 84 and the Ø2 clock signals are applied to line 86. These signals are out of phase with each other, as illustrated in FIG. 7, with each burst having a duration about the same as the decay time of the phosphor used in the electroluminescent devices as shown in FIG. 7. None of the electroluminescent devices 106, 108, 110 or 112 are turned on, since the photoconductors are, in each case, in their high-resistance state. Data in the form of a logic 1 or 0 may now be entered into the network 80 by the presence or absence, respectively, of data pulses 88 coinciding with the Ø1 pulses 90. The presence of pulse 88, illustrated in FIG. 7, turns electroluminescent device 94 on; this in turns directs light onto photoconductor 107 in module 100. With proper synchronization of the data pulse and the Ø1 clock signal, the light falling on photoconductor 107 reduces the resistance of unit 100 so that pulse 90 turns on electroluminescent device 106. This is illustrated in FIG. 7 by the curve 128. As long as the AC burst 90 is present on line 84 and is applied across the electroluminescent device 106, the device remains at its maximum brightness, since light from 106 falls on photoconductor 107 and holds its resistance at a low value. At the end of pulse 90 the light output from device 106 begins to decay, as shown by curve 128. It is noted that pulse 90 is also applied by way of line 84 to module 102, but since its photoconductor is not illuminated at this time, no conduction occurs and electroluminescent device 110 remains off.

Termination of pulse 90 coincides with the start of the Ø2 pulse 92 on line 86, which pulse is applied to units 101 and 103. Since light from electroluminescent device 106 is falling on photoconductor 109 at this time, the presence of pulse 92 turns on electroluminescent device 108 to produce light, illustrated by waveform 130 in FIG. 7, which falls on photoconductor 109 and on photoconductor 111. Electroluminescent device 108 remains at maximum brightness as long as pulse 92 is present, and then decays. It is noted that the presence of a data pulse on line 82 coinciding with pulse 92 would turn on device 94, but this would not be transferred to device 106, since no clock pulse is present on line 84; thus, only data pulses which coincide with Ø1 pulses will be transferred to the electroluminescent device 106.

The termination of pulse 92 marks the end of a clock cycle, and with the start of a second Ø1 pulse 90' which is again applied to modules 100 and 102, and thus is applied to electroluminescent devices 106 and 110. In the absence of a data pulse on line 82, however, electroluminescent device 106 is not turned on by pulse 90'. Because electroluminescent device 108 is now turned on (see waveform 130), photoconductor 111 is in its low resistance state, and the Ø1 pulse on line 84 will turn electroluminescent device 110 on, as indicated by waveform 132 in FIG. 7. Again, the electroluminescent device 110 will remain bright until the end of pulse 90' and will then begin to decay. A second Ø2 pulse 92' immediately follows the termination of the 01 second pulse 90', but since electroluminescent devices 106 and 108 have decayed to zero (see waveforms 128 and 130), no light is falling on photoconductor 109, and electroluminescent device 108 remains off.

The light from electroluminescent device 110 falls on photoconductor 113, and accordingly electroluminescent device 112 is turned on by pulse 92', as illustrated by waveform 134 in FIG. 7. In this manner, the data pulse 88 applied to line 82, which turns on the data entry electroluminescent device 94, is passed along the network 80 in synchronization with the clock pulses applied alternately to lines 84 and 86. Data in the form of 1s and 0s may in this way be entered into a network of any desired length, the data being entered serially and transferred along the network by the transfer pulses on lines 84 and 86.

Display of the data entered into the network is accomplished by applying a continuous display signal to one of the clock lines 84 and 86 immediately upon termination of the data entry process and before the illuminated devices have decayed so far that the data-containing modules have turned off. Only one of the lines 84 and 86 carries a continuous display signal, since if both were to carry such a signal, all of the electroluminescent devices could be turned on by optical coupling. As a result, the electroluminescent devices connected to the line which does not receive the display signal will all remain off. Those modules which are connected to the line receiving the display signal are data display modules; the remaining units are data transfer modules. For this reason, the electroluminescent modules 100–103 are paired to form display elements, or pixels; modules 100 and 101 are paired to form pixel 140, and electroluminescent modules 102 and 103 are paired to form pixel 141. Additional pixels such as 142, 143 and 144 may be provided in network 80, as indicated in phantom, and are similar to pixels 140 and 141.

For purposes of explanation, it will be assumed that the Ø2 line 86 carries the continuous display signal; accordingly, electroluminescent modules 101 and 103, which are connected to line 86, serve as the display modules while electroluminescent modules 100 and 102 serve as transfer modules. The loss of the transfer modules 100 and 102 for display purposes reduces the effective display area and thus the image resolution, but this is one of the tradeoffs made, in accordance with the present invention, to provide simple and effective serial data transfer into the network 80.

To illustrate the display capabilities of the pixels, assume that it is desired to display the logic sequence 01101 in the pixels 140–144, as elements of a larger image to be displayed on a panel. The logic sequence may be represented by pulse 88, a blank, pulses 150 and 152 and another blank, supplied to data line 82. Pulses 150 and 152 produce the illumination waveform 98, a blank, waveforms 154 and 156, and a blank (FIG. 7) on succeeding cycles of operation. The operation of network 80 on the first two cycles corresponding to Ø1 pulses 90 and 90' has been described, and enter a logic 1 and a logic 0 into the network. The third cycle begins with the data pulse 150, which coincides with Ø1 pulse 158, transferring the illumination produced by electroluminescent device 94 to electroluminescent device 106, as indiated by waveform 160. At the same time, the illumination of electroluminescent device 112 is transferred to pixel 142.

The Ø2 pulse 162 shifts the on condition to electroluminescent device 106 to electroluminescent device 108 and performs a similar operation in pixel 142, so that at the end of the third cycle, pixels 140 and 142 are on, and pixel 141 is off.

The application of data pulse 152 at the start of the fourth cycle illuminates electroluminescent device 94 as shown by waveform 156. The concurrent application of Ø1 pulse 166 to line 84 transfers the on condition of device 94 to electroluminescent device 106, as indicated by waveform 168. At the same time, the previous on condition of electroluminescent device 108 is transferred to electroluminescent device 110, as indicated by waveform 170, and the on condition of pixel 142 is transferred to pixel 143 in the same way. Ø2 pulse 172 is then applied to line 86 and transfers the on condition of electroluminescent device 106 to electroluminescent device 108, as indicated by waveform 174, and at the same time transfers the on condition of electroluminescent device 110 to electroluminescent device 112, as indicated by waveform 176, with the same effect occurring in pixel 143. At the end of this cycle, pixels 140, 141 and 143 are on, and pixel 142 is off.

If no data (logic 0) is entered on line 82 at the start of the fifth cycle of operation, electroluminescent device 94 is off and the Ø1 pulse 178 transfers a 0 into pixel 140, leaving electroluminescent device 106 off. At the same time, the on condition of electroluminescent device 108 is transferred to electroluminescent device 110, as indicated by waveform 180, and the on condition of electroluminescent unit 112 is transferred to the next succeeding pixel 142. In similar manner, the conditions of pixels 142 and 143 are transferred to their next succeeding pixels 143 and 144, respectively. When the next Ø2 signal 182 is supplied to line 86, electroluminescent device 108 remains off because it has decayed to 0 and because electroluminescent device 106 is off. However, because electroluminescent device 110 is on, the Ø2 signal 182 transfers that on condition to electroluminescent device 112, which is illuminated in the manner illustrated by waveform 184. In similar manner, the transferred conditions in the remaining pixels are shifted to the display units of the pairs.

At the end of the fifth cycle, pixels 141, 142 and 144 are on, and pixels 140 and 143 are off, representing the entry in time sequence of the logic data represented by 0,1,1,0,1. If the completion of the fifth cycle is immediately followed by a continuous display signal 186 on the display line 86, those display modules of the pixels which were on at the end of the fifth cycle will be held in their existing on conditions because of the self-illumination of their series photoconductors; the remaining pixels will remain off, thus providing a continuous image display of the inserted data. Thus it is seen that it is the condition of the display modules 101 and 103, and their electroluminescent devices 108 and 112 that determine the output luminescence of the pixels 140 and 142, while the devices 106 and 110 function only during the transfer of data along the network 180, and that pixels 142, 143, 144 and following pixels in the row function in the same manner. Thus, each pixel includes a transfer module and a data display module with each row comprising a plurality of pixels in side by side relationship optically and electrically coupled. The row can be as long as desired and as many rows as desired may be provided to produce a two dimensional matrix with pixels selectable by serial inputs only to the rows, the column locations of the pixels being selectable by the data input sequence.

Figure 8:
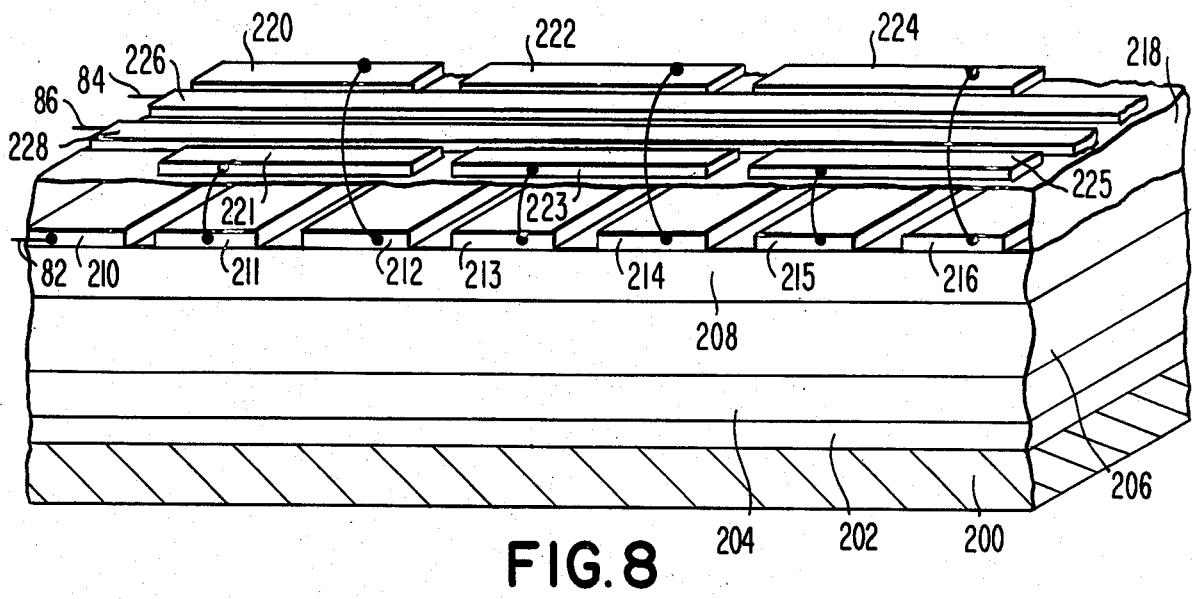
FIG. 8 is a diagrammatic illustration of a self-scanning structure.

FIG. 8 illustrates a portion of a possible structure for the device of FIG. 6, the device being mounted on a glass substrate 200 and including a transparent front electrode 202 and dielectric layer 204 of $Y_2O_3$ thin film material followed by a thin film layer 206 of ZnS:Mn. This electroluminescent phosphor material 206 is then covered with a further dielectric layer 208 consisting of $Y_2O_3$. Mounted on this dielectric layer are the transparent rear electrodes 210–216, by which electrical connections are made for the various electroluminescent devices. The electrodes are covered by a dielectric layer 218 of $Y_2O_3$ which, in turn, carries a plurality of CdS photoconductors 220–225, as well as the input electrodes 226 and 228 which are connected to input lines 84 and 86, respectively and receive the Ø1 and Ø2 illuminescent devices to which they respond, the photoconductor 220 lying over electrodes 210 and 211 and thus corresponding to photoconductor 107 in FIG. 6. FIG. 8 provides an illustration of a possible configuration for a network of electroluminescent devices, but other configurations are possible.

Figure 9:
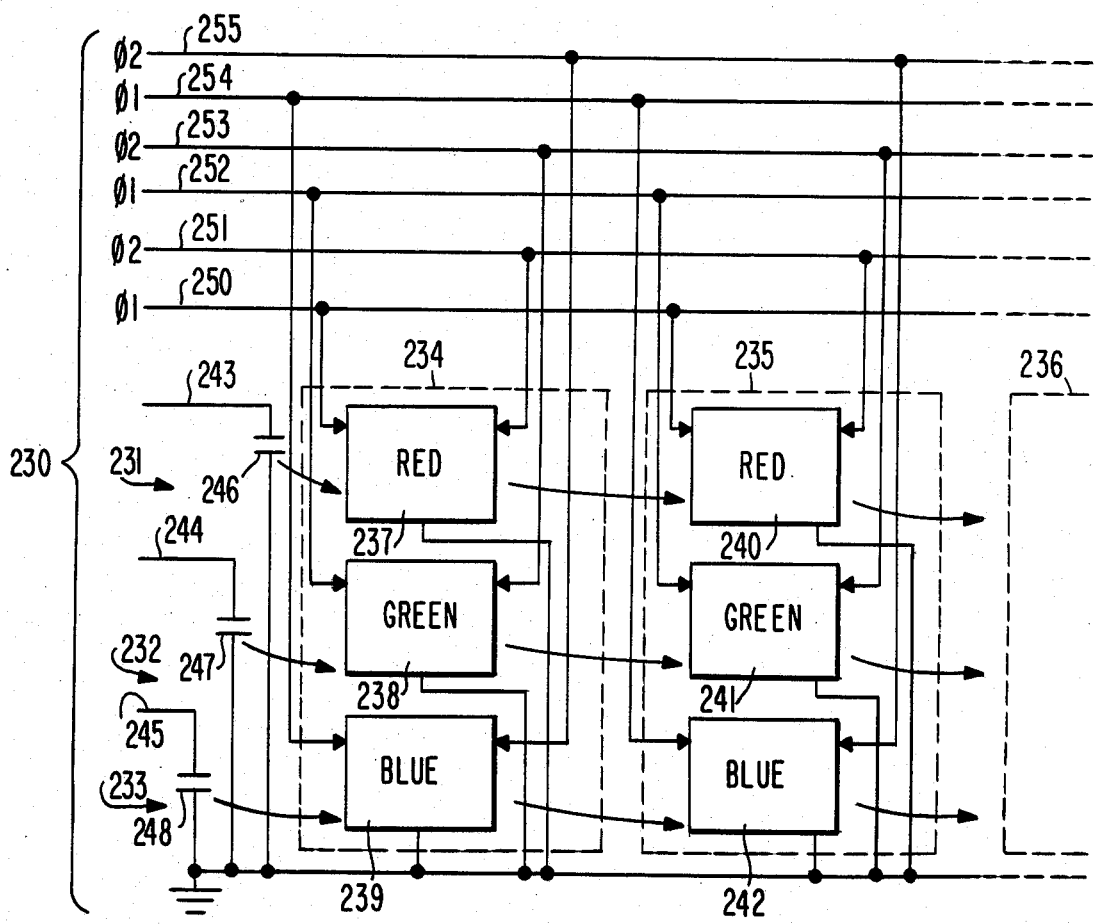
FIG. 9 is a schematic illustration of a multicolor display network.

Although FIGS. 6–8 have been described in terms of a single color ZnS phosphor producing a monochromatic output, a full color electroluminescent display that is self-scanning may be provided using the basic network structure illustrated, as shown in FIG. 9. In such an arrangement, the ZnS electroluminescent film used for each of the electroluminescent devices is doped with spacially selective activators to provide different colors. Thus, the ZnS film is doped with a high resolution matrix of alternating Mn and $TbF_3$ activators so that adjacent regions appear green and yellow. A color filter matrix with high spacial resolution is fabricated as a thin film on the electroluminescent thin film structure, and then each row of color pixels is fabricated as a set of three subrows of self-scanned pixels, each subrow being similar to that illustrated in FIG. 6. These subrows are aligned with the high resolution activator matrix and color filter matrix so that the electroluminescent devices of each subrow emit a different color. The subrows display the colors red, green and blue, the red subrow being doped with Mn and having a red filter, the green subrow being doped with $TbF_3$ and having no filter, and the blue subrow being doped with $TbF_3$ and having a blue filter.

In FIG. 9, a part of a single row 230 is illustrated as having three subrows 231, 232 and 233. Row 230 includes, for example, three-color pixel assemblies 234, 235, 236, etc., with pixel assembly 234 consisting of a red pixel 237, a green pixel 238, and a blue pixel 239. Similarly, pixel assembly 235 includes red, green and blue pixels 240, 241 and 242, and so on, for successive pixel assemblies. Subrow 231 includes red pixels 237 and 240, subrow 232 includes green pixels 238 and 241, and subrow 233 includes blue pixels 239 and 242. The subrows have corresponding data entry lines 243, 244 and 245, respectively, which supply data pulses to data entry electroluminescent devices 246, 247 and 248, respectively.

Each subrow is driven by its own data transfer signals, lines 250 and 251 providing Ø1 and Ø2 signals to subrow 231, lines 252 and 253 providing Ø1 and Ø2 signals to subrow 232, and lines 254 and 255 providing Ø1 and Ø2 signals to subrow 233. This allows each subrow to be driven by transfer and display signals of an amplitude and frequency appropriate to the requirements of their particular color phosphors, and permits control of the relative average brightness of the color components of each pixel in a row to be controlled for the desired color balance.

In operation, data is shifted into the three subrows in parallel. Then, in the display cycle the three Ø2 lines corresponding to the three subrows are driven at three independent frequencies, the frequencies being selected to equalize the brightness variations caused by the various activator and filter efficiencies in the subrows. By varying the frequency of these display signals, the brightnesses can be controlled and thus the overall color produced by each row can be controlled.

Figure 10:
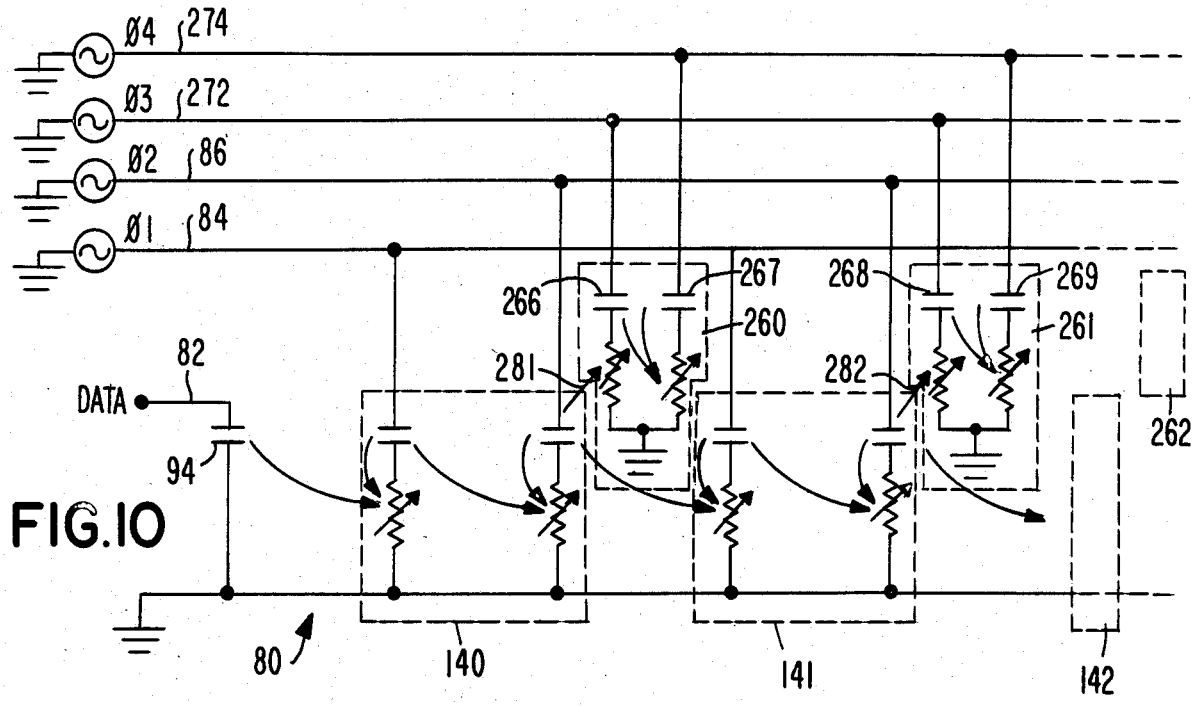
FIG. 10 is a schematic illustration of a modified form of the network of FIG. 6.

Another modification of the self-scanning system of FIG. 6 is illustrated in FIG. 10, to which reference is now made. In this modification, the network 80 is reproduced, with the same numbers identifying the same parts as in FIG. 6, and thus includes a data input line 82 and a data input electroluminescent device 94, pixels 140, 141, 142, etc., and Ø1, Ø2 input lines 84 and 86, respectively.

The modification of network 80 enables information that is shifted into the network to be transferred to a parallel row of auxiliary pixels identified at 260, 261 and 262, etc. Information shifted into the pixels 140, 141, 142 etc., is transferred to corresponding auxiliary pixels 260, 261, 262, etc., for display while new information is entered into the initial pixels 140, 141, 142, etc. Once this new information has been entered, the entire auxiliary row may be updated in parallel, and the new information displayed by the auxiliary pixels.

As with the device of FIG. 6, lines 84 and 86 are alternately pulsed by the Ø1 and Ø2 signals while data is entered in the form of logic 1s and 0s, as desired. Data is transferred from the input electroluminescent device 94 to the pixels 140, 141, etc., as described with respect to FIG. 6. In addition, pixel 140 is optically coupled to pixel 260, which contains electroluminescent devices 266 and 267, and pixel 141 is optically coupled to pixel 261, which contains electroluminescent devices 268 and 269. Devices 266 and 268 are connected in series with corresponding photoconductors by which the auxiliary pixels are optically coupled to pixels 140 and 141. Devices 266 and 168 are also connected to a Ø3 line 272 and serve as transfer devices in their respective pixels. Electroluminescent devices 267 and 269 are connected to the Ø4 line 274 and are connected in series with corresponding photoconductors which are illuminated by both electroluminescent devices in their respective pixels.

Figure 11:
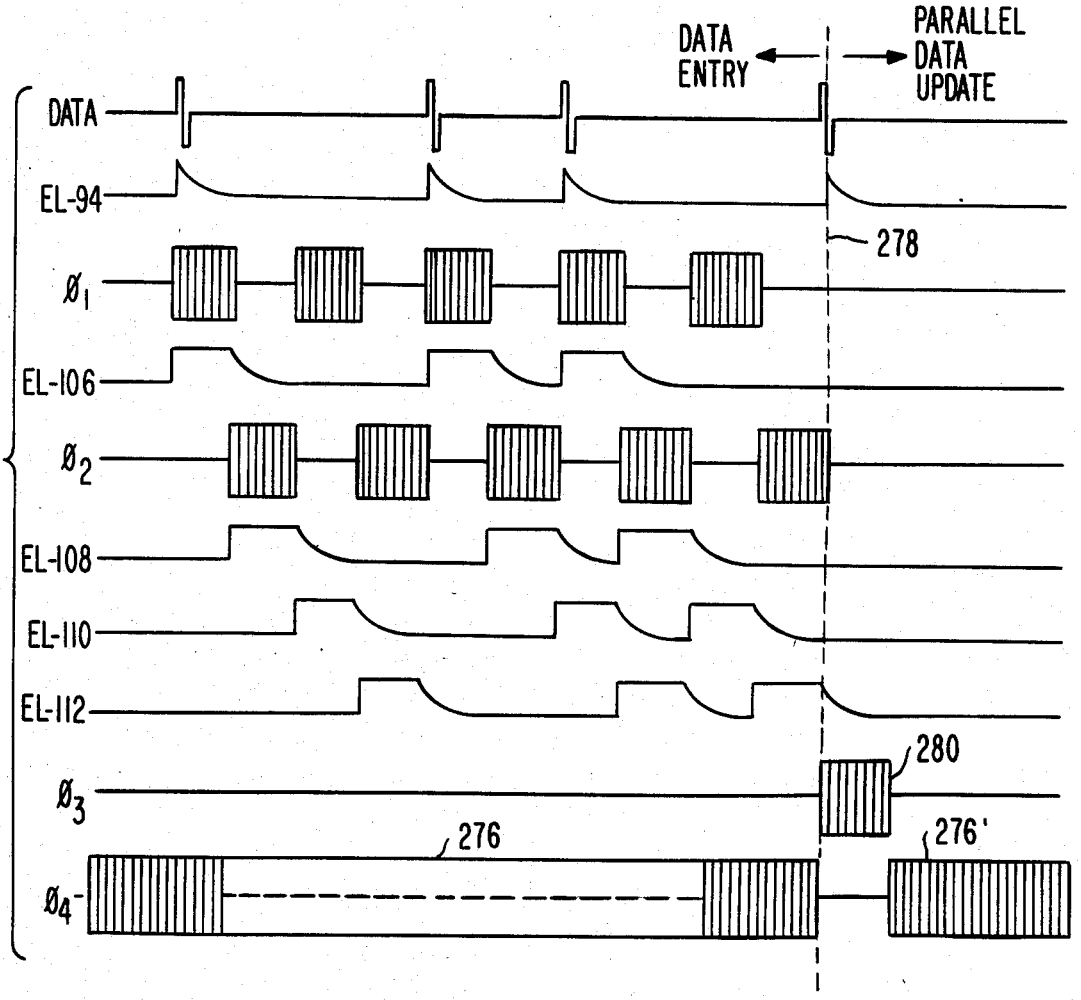
FIG. 11 illustrates the waveforms generated in the operation of the network of FIG. 10.

During the data entry cycle, the Ø3 drive signal is off, neither of the transfer devices 266 or 268 are luminescent, and thus no data is transferred in the auxiliary pixels, even thought data may be transferred in the primary pixels 140, 141, etc. During this same time period, however Ø4 is driven continuously, as indicated by waveform 276 in FIG. 11, supplying a voltage to electroluminescent devices 267 and 269 and causing them to be luminescent if their respective series photoconductors have previously been made conductive by their corresponding transfer devices. Thus, devices 267 and 269 act to display information from a previous data entry. At the end of the data entry sequence, or mode, for network 80, indicated by the vertical line 278 in FIG. 11, Ø3 is activated, as indicated by waveform 280, and the data represented by the on or off conditions of the display electroluminescent devices in pixels 140, 141, 142, etc., are transferred by the optical coupling indicated by arrows 281, 282 to the transfer devices of the auxiliary pixels 260, 261, 262, etc. Simultaneously, the Ø4 drive signal, indicated by waveform 276 is stopped, thereby turning off the display devices 267 and 269 to erase previous data in the auxiliary pixels. Then when the Ø4 signal starts again, as indicated at 276', the updated information is shifted from the transfer electroluminescent devices in the auxiliary pixels to the display electroluminescent devices, where it remains until a new row of data has been shifted into place.

In this way, new information can be shifted into a row without affecting the information already on display. To take advantage of this scheme, a short lifetime electroluminescent material may be used to perform the data input function and a slower, brighter material may be used for the actual display in the auxiliary pixels. This enables faster data entry while allowing a brighter display wherein the colors of the display pixels are not influenced by the data entry rate that may be desired. It is further noted that a moving picture display is possible if the data for an entire row can be shifted in during a single frame period.

Although the present invention has been described in terms of preferred embodiments, it will be apparent that numerous variations and modifications can be made without departing from the true spirit and scope thereof as defined in the following claims.

What is claimed is:

1. A self-scanning electroluminescent display, comprising:

a plurality of hysteretic electroluminescent modules electrically and optically interconnected to form a row of pixels, each said pixel including a pair of modules and each said module comprising an electroluminescent device and a series-connected photoconductive means;

data entry means for said row of pixels;

transfer means for serially transferring data from one module to the next following module along said row of pixels; and means for displaying the data in each said pixel.

2. The display of claim 1, wherein said data entry means comprises a data entry electroluminescent device selectably energizable to illuminate a first module in said row of pixels.

3. The display of claim 2, wherein said data entry means includes circuit means for selectively energizing said data entry electroluminescent device.

4. The display of claim 1, wherein said transfer means includes first means for energizing the first module of said pair in each said pixel, and second means for energizing the second module of said pair in each said pixel.

5. The display of claim 1, wherein said transfer means includes first and second transfer circuit means for energizing the first and second module, respectively, of each said pixel.

6. The display of claim 5, wherein said first transfer circuit means includes means for supplying AC signals of a first phase to said first module of each said pixel and wherein said second transfer means includes means for supplying AC signals of a second phase to said second module of each said pixel.

7. The display of claim 6, wherein said AC signals of first and second phases alternate with each other to transfer entered data from one pixel to the next.

8. The display of claim 7, wherein said means for displaying the data in each said pixel comprises means for supplying an AC display signal to only one module in each said pixel.

9. A self-scanning electroluminescent display, comprising:

a plurality of hysteretic electroluminescent modules electrically and optically interconnected to form a row of pixels, each said pixel including a pair of modules and each said module comprising an electroluminescent device and a series-connected photoconductive means;

data entry means for serially entering into said row of pixels data signals for selectively turning on and off a first module in a first of said row of pixels;

transfer means for serially transferring the data represented by the on or off condition of said first module from one pixel to the next following pixel along said row of pixels; and display means for renewing the on or off condition of each pixel in said row to display the data entered therein.

10. The display of claim 9, wherein said data entry means includes means optically coupled with the photoconductive means of a first module in said row of pixels for turning said first module on and off.

11. The display of claim 10, wherein said transfer means comprises means optically coupling each said module in a row with the next following module in said row.

12. The display of claim 11, wherein said transfer means further comprises transfer circuit means connected to each said module.

13. The display of claim 11, wherein said transfer means further comprises first and second transfer circuit means connected to corresponding first and second modules of the pair of modules in each said pixel.

14. The display of claim 13, wherein said transfer means further includes means for supplying AC signals of a first phase to said first modules and AC signals of a second phase to said second modules in each said pixel, said first and second phases alternating to transfer the on or off condition of one module to the next following module.

15. The display of claim 14, further including a plurality of auxiliary pixels, each auxiliary pixel corresponding to one of said row of pixels, and means for transferring in parallel to each of said auxiliary pixels the on or off condition of its corresponding pixel in said row.

16. The display of claim 15, wherein each said auxiliary pixel includes first and second modules, each module comprising an electroluminescent device and a series-connected photoconductive means.

17. The display of claim 16, wherein said means for transferring said on or off condition includes auxiliary transfer means for said auxiliary pixels, said auxiliary transfer means including third and fourth transfer circuit means connected to the first and second modules, respectively, of each auxiliary pixel.

18. The display of claim 17, wherein said third circuit means includes pulse means for transferring the said on or off condition of said corresponding pixels into said auxiliary pixels, and said fourth circuit means includes signal means for producing a display of said transferred on or off conditioning.

19. The display of claim 14, wherein said display means comprises means for supplying an AC display signal to only one module in each said pixel.

20. A self-scanning electroluminescent display, comprising:

a plurality of hysteretic electroluminescent modules electrically and optically interconnected to form a subrow of pixels, at least first and second subrows constituting a row of pixel assemblies, with at least one pixel from each subrow combining to form each pixel assembly;

a pair of modules forming each said pixel, each module comprising an electroluminescent device and a series-connected photoconductive means, the electroluminescent devices for said first subrow producing, when excited by an AC signal, a color different than that produced by the electroluminescent devices of said second subrow when excited by an AC signal;

data entry means for each said subrow for serially entering data signals for selectively turning on and off a first module in the corresponding subrow;

transfer means for each subrow for serially transferring the data represented by the on or off condition of said first module from one pixel to the next following pixel along that subrow of pixels; and display means for each subrow for renewing the on or off condition of each pixel in the corresponding subrow to display the data entered therein, the display provided by each pixel assembly being a combination of the different colors produced by the pixel modules within said pixel assembly.

21. The display of claim 20, wherein said display means for each said subrow comprises means for supplying an AC display signal to only one moduel in each said pixel of said subrow.

22. The display of claim 21, wherein said AC display signal has a frequency corresponding to the intensity of luminescence desired from said electroluminescent devices, whereby a desired color is produced by a pixel assembly.

23. A method of displaying an image on a display including a plurality of hysteretic eleotroluminescent modules optically and electrically coupled to form a row of pixels, each pixel having a pair of modules, and each module comprising an electroluminescent device and a series-connected photoconductive means comprising:

entering data into said row of pixels in the form of logic 1s and 0s representing a pattern to be displayed by said row;

transferring said data along said row from one pixel to the next to produce luminescence in selected pixels in accordance with the entered data; and displaying the entered data by application of renewal signals to one module in each pixel.

* * * * *